US006152149A

United States Patent [19]

Miller et al.

[11] Patent Number: 6,152,149

[45] Date of Patent: Nov. 28, 2000

[54] METHOD OF CLEANING A CABLE USING A BROMINATED HYDROCARBON AND ESTER SOLUTION

[75] Inventors: Glenn Miller, Brookpark; Robert Washburn, Amherst, both of Ohio

[73] Assignee: Arnco Corporation, Elryia, Ohio

[21] Appl. No.: 09/469,686

[22] Filed: Dec. 22, 1999

Related U.S. Application Data

[62] Division of application No. 09/095,484, Jun. 10, 1998.

[51] Int. Cl.[7] ..... B08B 1/00

[52] U.S. Cl. ..... 134/6; 134/2; 134/22.1; 134/22.19; 134/34; 134/36; 134/40; 134/42; 510/108; 510/109; 510/412; 510/437; 510/488

[58] Field of Search ..... 134/2, 6, 22.1, 134/22.19, 34, 36, 40, 42; 510/412, 437, 488, 108, 109

[56] References Cited

U.S. PATENT DOCUMENTS

| | | | |
|---|---|---|---|
| 3,928,210 | 12/1975 | Peterson | 252/8.1 |
| 4,086,179 | 4/1978 | Schneider | 252/171 |
| 4,225,649 | 9/1980 | Peterson | 428/383 |
| 4,877,545 | 10/1989 | Merchant et al. | 252/171 |
| 5,114,609 | 5/1992 | Buchwald et al. | 252/171 |
| 5,219,488 | 6/1993 | Basu et al. | 252/171 |
| 5,238,504 | 8/1993 | Henry | 134/40 |
| 5,259,983 | 11/1993 | Van Der Puy et al. | 252/171 |
| 5,294,263 | 3/1994 | Riso | 134/40 |
| 5,403,507 | 4/1995 | Henry | 252/170 |
| 5,418,884 | 5/1995 | Caudrelier | 385/147 |
| 5,431,837 | 7/1995 | Matsuhisa et al. | 252/171 |
| 5,445,757 | 8/1995 | Pennetreau | 252/171 |
| 5,482,645 | 1/1996 | Maruyama et al. | 252/170 |
| 5,492,645 | 2/1996 | Oshima et al. | 252/171 |
| 5,522,939 | 6/1996 | Light, Jr. et al. | 134/6 |
| 5,552,080 | 9/1996 | Bolmer | 510/412 |
| 5,616,549 | 4/1997 | Clark | 510/412 |
| 5,665,170 | 9/1997 | Lee et al. | 134/19 |
| 5,665,172 | 9/1997 | Oshima et al. | 134/40 |
| 5,669,985 | 9/1997 | Lee et al. | 134/40 |
| 5,679,632 | 10/1997 | Lee et al. | 510/412 |
| 5,690,862 | 11/1997 | Moore, Jr. et al. | 252/364 |
| 5,707,954 | 1/1998 | Lee | 510/412 |
| 5,792,277 | 8/1998 | Shubkin et al. | 134/19 |
| 5,814,595 | 9/1998 | Flynn et al. | 510/411 |
| 5,824,162 | 10/1998 | Clark | 134/31 |
| 5,858,953 | 1/1999 | Aman et al. | 510/412 |

FOREIGN PATENT DOCUMENTS 19926071 12/1999 Germany .

*Primary Examiner*—Sharidan Carrillo
*Attorney, Agent, or Firm*—Pearne & Gordon LLP

[57] ABSTRACT

A method of cleaning a power cable having a semi-conductive layer includes wiping the semi-conductive layer with a cleaning solution comprising a brominated hydrocarbon selected from the group consisting of n-propyl bromide and isopropyl bromide to remove at least a portion of the semi-conductive layer.

8 Claims, 1 Drawing Sheet

METHOD OF CLEANING A CABLE USING A BROMINATED HYDROCARBON AND ESTER SOLUTION

This application is a divisional of application Ser. No. 09/095,484, filed Jun. 10, 1998.

BACKGROUND OF THE INVENTION

This invention relates to cleaning solutions and in particular to cold-cleaning solutions for optical and electrical conductors, and electrical contacts.

Cold-cleaning solutions are used to clean cables, equipment, and tools in the electrical power industry. Cold-cleaning solutions are also used to clean fiber-optic cables and to remove flux and flux residue from circuit boards. Typically, a cold-cleaning solution is applied to an object by spraying the cold-cleaning solution on the object using an aerosol or other type of propellent, or by wiping the object with a cloth or sponge soaked with the cold-cleaning solution, and then allowing the cold-cleaning solution to evaporate into the surrounding environment.

Since the cold-cleaning solution is allowed to evaporate into the surrounding environment, the cold-cleaning solution should not evaporate so as to produce a flammable vapor or leave behind a flammable liquid. In addition, the cold-cleaning solution should not evaporate too quickly, such that the cold-cleaning solution does not have time to carry contaminants away from the object, or too slowly, such that further processing of the object is unduly delayed. The cold-cleaning solution also should not be hazardous to humans, or to the environment.

In the electric power industry, the requirements are especially rigorous for a cold-cleaning solution for cable splice preparation. A high-voltage power cable typically includes a conductor covered with an inner semi-conductive layer and a primary insulation layer. The semi-conductive layer is thin and is typically composed of a polymer, such as polyethylene. If a splice has to be made in the cable, the semi-conductive layer must first be completely removed from the portions of the conductor to be adjoined. Otherwise, the splice will have a reduced current-carrying capacity and will ultimately fail. The semi-conductive layer is at least partially removed using a cold-cleaning solution.

Splices in high-voltage power cables are often made under unfavorable conditions. Thus, splices are typically made in a quick manner. Accordingly, it is desirable to use a cold-cleaning solution with a high penetrating ability and good solubility characteristics that evaporates quickly and leaves little if any contaminating residue. It is also desirable for the cold-cleaning solution to have a high dielectric strength so that any solution molecules that do get trapped within the splice will not readily ionize and thereby degrade the primary insulation layer. Since the cold-cleaning solution is often used in confined spaces, such as manholes, it is important that the cold-cleaning solution be non-flammable and non-hazardous to humans.

Traditionally, 1,1,1 Trichloroethane (TCA) was used as the cold-cleaning solution for high-voltage power cables because it has a high penetrating ability and good solubility characteristics, especially with regard to polyethylene, and has a high dielectric strength, a good evaporation rate, and is non-flammable. TCA, however, was identified, along with other chloro-fluoro compounds, as depleting the ozone layer and its manufacture in the U.S. after 1996 was banned. Accordingly, other cold-cleaning solutions have been developed to replace TCA. An example of such a replacement cold-cleaning solution is disclosed in U.S. Pat. No. 5,238,504 to Henry, which is hereby incorporated by reference. Henry discloses a cold-cleaning solution for use in the electrical power industry, wherein the cold-cleaning solution comprises a blend of terpene hydrocarbons and aliphatic or cyclic ketones.

Other replacement cold-cleaning solutions include petroleum distillates, fluroethers and certain chlor-fluoro compounds, and glycol ethers and glycol esters. Such replacement cold-cleaning solutions, however, do not possess all of the favorable characteristics of TCA. Some of the replacement cold-cleaning solutions are flammable, some have a low evaporation rate, and some have mediocre solubility characteristics.

Based upon the foregoing, there is a need in the art for an improved cleaning solution, especially for use in the electrical power industry. The present invention is directed to such a cleaning solution.

SUMMARY OF THE INVENTION

It therefore would be desirable, and is an advantage of the present invention, to provide an improved cleaning solution. In accordance with the present invention, the cleaning solution includes about 40–98 volume percent of a brominated hydrocarbon and about 2–60 volume percent of an ester.

Also provided in accordance with the present invention is a method of using a cleaning solution to prepare a high-voltage power cable for splicing, wherein the cable includes a conductor surrounded by a semi-conductive layer, an insulating layer, and an outer jacket. In accordance with the method, the cleaning solution comprises a brominated hydrocarbon selected from the group consisting of n-propyl bromide and isopropyl bromide. A piece of material capable of absorbing the cleaning solution is selected. A portion of the insulating layer and the outer jacket are removed to expose a portion of the semi-conductive layer. The piece of material is soaked with the cleaning solution. The semi-conductive layer is wiped with the piece of material soaked with the cleaning solution so as to remove at least a portion of the semi-conductive layer.

BRIEF DESCRIPTION OF THE DRAWING

The features, aspects, and advantages of the present invention will become better understood with regard to the following description, appended claims, and accompanying drawing where:

DETAILED DESCRIPTION OF THE PREFERRED EMBODIMENTS

Figure 1:
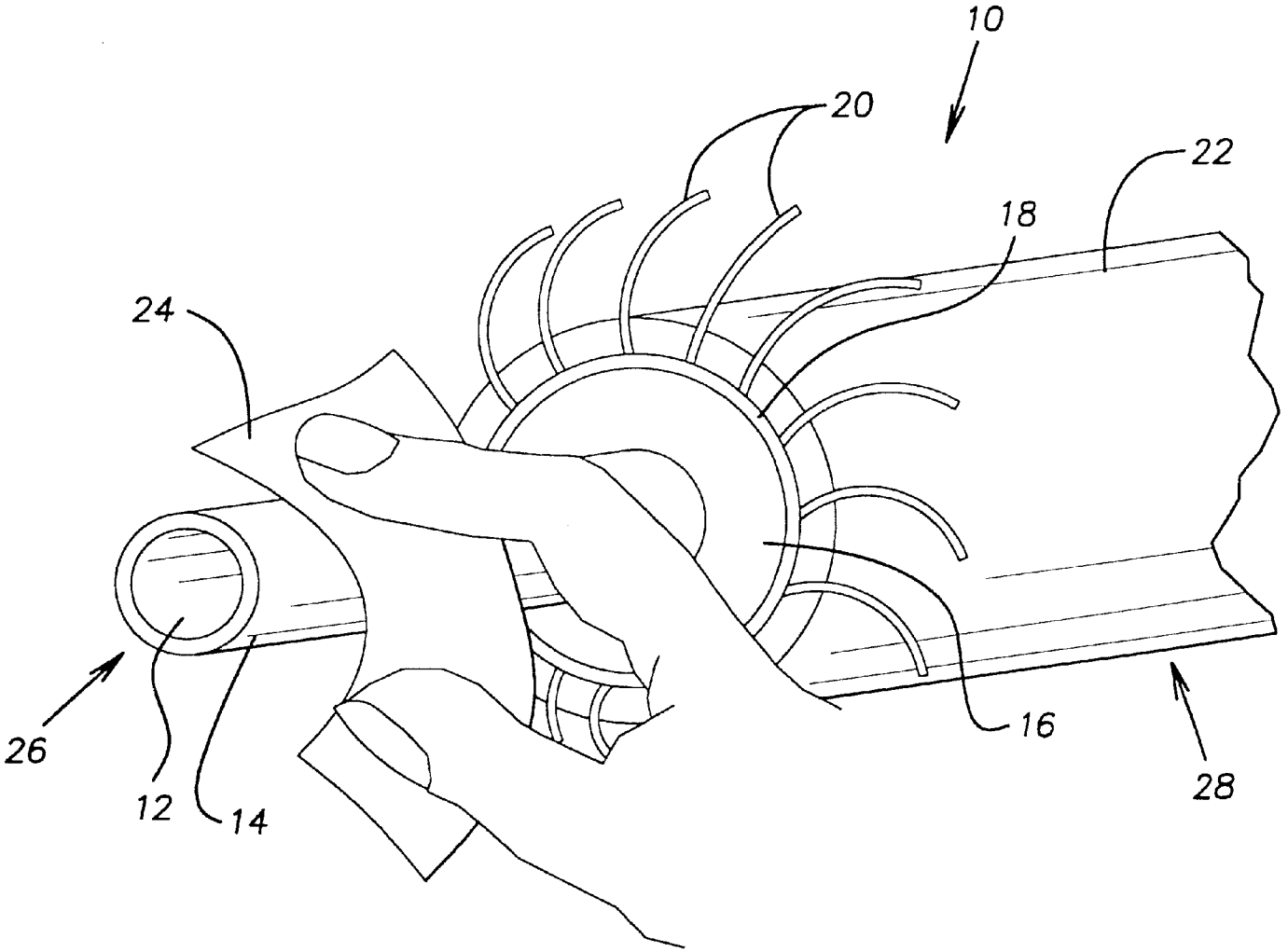
FIG. 1 shows a perspective view of a high-voltage power cable being cleaned prior to splicing.

It should be noted that in order to clearly and concisely disclose the present invention, the drawing may not necessarily be to scale and certain features of the invention may be shown in somewhat schematic form.

It should also be noted that parts are parts by volume and percents are volume percents unless otherwise indicated or apparent. In addition, it should be noted that when a preferred range such as 5–25 is given, this means preferably at least 5 and preferably not more than 25.

The solvent system or cleaning solution of the present invention has a preferred formulation (Formulation 1) of: about 70 volume percent (less preferably about 55–85 volume percent, less preferably about 50–95 volume percent, less preferably about 40–98 volume percent, less preferably about 40–100 volume percent) brominated hydrocarbon, and about 30 volume percent (less preferably about 15–45 volume percent, less preferably about 5–50 volume percent, less preferably about 2–60 volume percent, less preferably about 0–60 volume percent) ester. Formulation 1 in tabular summary form is as follows:

| | Component | Volume Percent Preferred | Less Preferred | Less Preferred |
|---|---|---|---|---|
| 1. | Brominated Hydrocarbon | 70.0 | 55–85 | 40–100 |
| 2. | Ester | 30.0 | 15–45 | 0–60 |

The brominated hydrocarbon component of the present invention is comprised of one or more brominated hydrocarbons having the formula $C_nH_{2n+1}Br$, where n is a number of 3 or greater, more preferably 3 to 8, more preferably 3 to 6. Examples of such brominated hydrocarbons include n-propyl bromide, isopropyl bromide, n-butyl bromide, isobutyl bromide, sec-butyl bromide, n-amyl bromide, isoamyl bromide, and n-hexyl bromide. More preferably, however, the brominated hydrocarbon component is n-propyl bromide, or isopropyl bromide. Since isopropyl bromide has been identified as a possible ozone depletor, the brominated hydrocarbon component is still more preferably n-propyl bromide.

N-propyl bromide is a clear, colorless to slightly yellow, liquid, and has a boiling point of about 70.8° C. (159° F.). N-propyl bromide has a very high evaporation rate, being 8 times the rate of n-butyl acetate (nBA), which is typically used as a base-line. Such a high evaporation rate is desirable for many cold-cleaning applications, but is undesirable for some cold-cleaning applications. For example, it has been found that when n-propyl bromide is used to clean a high-voltage power cable, the n-propyl bromide often evaporates before the cleaning is completed.

The production of n-propyl bromide usually results in the co-production of minor amounts of isopropyl bromide and lesser amounts of impurities, such as propyl alcohol, propyl ether, propyl chloride, propylene, propane, and butyl bromide. Thus, crude n-propyl bromide is generally 90 weight percent n-propyl bromide with the remaining 10 weight percent being isopropyl bromide and impurities. More purified grades of n-propyl bromide are available having compositions up to 99+ weight percent n-propyl bromide. The brominated hydrocarbon component of the present invention is preferably 90 to 99+ weight percent n-propyl bromide, more preferably 99+ weight percent n-propyl bromide. Purified n-propyl bromide having 99+ weight percent n-propyl bromide is available from the Albemarle Corporation of Richmond, Va. and from Great Lakes Chemical Corporation of West Lafayette, Ind.

N-propyl bromide has been variously reported as being non-flammable and flammable. The National Fire Protection Association, Inc. (NFPA) in NFPA 325, "Guide to Fire Hazard Properties of Flammable Liquids, Gases, and Volatile Solids", 1994 Edition, gives n-propyl bromide a flammability hazard rating of 3. The NFPA comment for a "3" rating states that "this degree includes Class 1B and 1C flammable liquids and materials that can be easily ignited under almost all normal conditions".

Although NFPA 325 gives n-propyl bromide a relatively high flammability hazard rating, NFPA 325 does not list a flash point temperature for n-propyl bromide. In addition, producers of n-propyl bromide have stated that n-propyl bromide does not have a flash point (See the data sheet for n-propyl bromide provided by the Albemarle Corporation).

The flash point of a specimen is the lowest temperature corrected to a barometric pressure of 101.3 kPa (760 mm Hg), at which application of a test flame causes the vapor of the specimen to ignite under specified conditions of test. The flash point provides a measure of the tendency of the specimen to form a flammable mixture with air under controlled conditions.

Flash point tests were conducted on samples of n-propyl bromide using a Pensky-Martens closed-cup tester in accordance with ASTM D 93. At any temperature a small blue halo was observed to form around a cup of the tester. A large flame, however, did not form at any temperature. Paragraph 3.1.1.1 of ASTM D 93 states that "The sample is deemed to have flashed when a large flame appears and instantaneously propagates itself over the surface of the sample." In addition, Paragraph 3.1.1.2 states that "Occasionally, the application of the test flame will cause a blue halo or an enlarged flame. This generally occurs near the actual flash point but in some cases, especially with halogenated hydrocarbons and admixtures, can occur at any temperature. These phenomena are not to be considered true flash points." Based upon this standard, n-propyl bromide does not have a flash point.

A further test, similar to ASTM D 4207-91, was conducted to determine the sustained burning characteristics of n-propyl bromide. A planar wooden stick was immersed in a container of n-propyl bromide and then removed. The stick was briefly brought into contact with a small flame and then observed. A larger flame briefly developed around the stick and then quickly extinguished. The larger flame lasted less than one second. This stick test indicates that n-propyl bromide fails to sustain burning.

The absence of a flash point for n-propyl bromide and the failure of n-propyl bromide to sustain burning indicates that n-propyl bromide is not flammable.

The ester component of the present invention is comprised of one or more esters having the formula $C_nH_{2n}O_2$, where n is a number of 2 or greater, more preferably 2 to 8, more preferably 2 to 6. Examples of such esters include methyl formate $C_2H_4O_2$, ethyl formate and methyl acetate ($C_3H_6O_2$), ethyl acetate ($C_4H_8O_2$), propyl acetate and isopropyl acetate ($C_5H_{10}O_2$), and n-butyl acetate, isobutyl acetate, and tert-butyl acetate ($C_6H_{12}O_2$). More preferably, the ester component is tert-butyl acetate or ethyl acetate. Still more preferably, the ester component is ethyl acetate. While ethyl acetate has a faster evaporation rate and better solvency than tert-butyl acetate, evidence shows that tert-butyl acetate may be exempt from volatile organic compound (VOC) classification, thereby making tert-butyl acetate desirable for regions where VOCs are a concern.

The production of ethyl acetate usually results in the co-production of minor amounts of ethanol. Thus, crude ethyl acetate is generally about 85–88 weight percent ethyl acetate with the remaining 12–15 weight percent being ethanol and impurities. More purified grades of ethyl acetate are available having compositions up to 99+ weight percent ethyl acetate. The ester component of the present invention is preferably 85 to 99+ weight percent ethyl acetate, more preferably 99+ weight percent ethyl acetate. Purified ethyl acetate having 99+ weight percent ethyl acetate is available from Fisher Scientific, Inc. of Atlanta Ga., and Eastman Chemical Co. of Kingsport, Tenn.

Ethyl acetate is a clear liquid with a characteristic fruity odor, has a boiling point of about 77° C. (170.6° F.), and an open cup flash point of 7.2° C. (45° F.). NFPA 325 gives ethyl acetate a flammability hazard rating of 3, which is the same as n-propyl bromide. Ethyl acetate has a fairly high evaporation rate, being about 4.2 times the rate of n-butyl acetate (nBA).

The amount of the ester component used in the cleaning solution of the present invention should not be great enough to provide the cleaning solution with a flash point. It has been determined that the cleaning solution will not have a flash point if the amount of the ester component is 60 volume percent or less of the cleaning solution.

The cleaning solution of the present invention may also include a stabilizer component, especially if the brominated hydrocarbon component is n-propyl bromide and the cleaning solution is used to clean metal. Metals such as magnesium, titanium, steel and aluminum can act as catalysts that dehydrobrominate the n-propyl bromide. The dehydrobromination produces HBr, which, in turn, corrodes the metals.

Generally, any of the conventional stabilizers which are taught by the art to be useful in stabilizing halogenated hydrocarbon solvents are suitable for use as the stabilizer component. The stabilizer component may include nitroalkanes, ethers, epoxides, amines, or any combination thereof. U.S. Pat. No. 5,690,862 to Moore Jr. et al., which is incorporated herein by reference, lists a plurality of stabilizers which may be used as the stabilizer component. Preferably, the amount of the stabilizer component is less than 0.1 weight percent of the cleaning solution.

The brominated hydrocarbon component and the ester component of the present invention are miscible with each other. Thus, the brominated hydrocarbon component and the ester component can be conventionally blended together in any order, and without any special requirements so as to form the cleaning solution of the present invention. The cleaning solution of the present invention is substantially clear, has a slight fruity odor, and is non-azeotropic. The cleaning solution is non-flammable, has a high penetrating ability, excellent solubility characteristics, evaporates quickly, and leaves no measurable non-evaporative components or break-down products. In addition, the cleaning solution readily swells polyethylene and ethylene-propylene-diene monomer (EPDM), and has a high dielectric strength, making the cleaning solution ideally suited for cleaning high-voltage power cables.

The cleaning solution of the present invention can be used in a variety of applications. The cleaning solution can be used to clean grease, oil and other contaminants from metal parts or wiring assemblies, such as motor and transformer windings, and to remove flux and flux residue from circuit boards. In addition, the cleaning solution can be used to clean fiber optic cables prior to splicing thereof. More specifically, the cleaning solution can be used to remove plastic cladding and water blocking gels that typically cover glass optical fibers within the cables.

As stated above, the cleaning solution of the present invention is also ideally suited for cleaning high voltage power cables prior to splicing or termination. With reference now to FIG. 1, a conventional high-voltage power cable 10 is shown. The cable 10 comprises an inner conductor 12 surrounded by a thin inner semi-conductive layer 14 and a primary insulation layer 16. The inner semi-conductive layer 14 is composed of polyethylene. The primary insulation layer 16, in turn, is surrounded by an outer semi-conductive layer 18, neutral conductors 20, and an outer jacket 22.

In order to make a splice in the high-voltage power cable 10, the outer jacket 22 is removed using a conventional stripping tool (not shown) that is known in the art. The neutral conductors 20 are then gathered back. Afterwards, the outer semi-conductive layer 18 and the primary insulation layer 16 are removed using the stripping tool. Although not shown in FIG. 1, most of the inner semi-conductive layer 14 is also preferably removed using the stripping tool.

Preferably, the conductor 12 and the inner semi-conductive layer 14 are lightly sanded with a clean emery cloth (not shown) until the conductor 12 is free of any visible portion of the inner semi-conductive layer 14. A piece of material 24 capable of absorbing the cleaning solution of the present invention is soaked in the cleaning solution. The material 24 is preferably lint-free cloth. The material 24 is wiped over the conductor 12 to lift and remove any remnants of the semi-conductive layer 14 or other contaminants on the conductor 12. Preferably the material 24 is wiped from a free end 26 of a stripped portion of the cable 10 to an unstripped portion 28 of the cable 10. After the wiping is complete, the cleaning solution on the conductor 12 is allowed to completely evaporate.

A second piece of material (not shown) is soaked in the cleaning solution of the present invention. The second piece of material is wiped over splice couplings or terminations (as applicable) to remove any surface oil or other contamination. After this wiping is complete, the cleaning solution on the couplings or terminations is allowed to completely evaporate.

The splice couplings or terminations are then installed to form a splice or termination(s). The splice is insulated with butyl mastic sealant tape or pad and/or an EPDM stretch rubber tape. Finally, a heat-shrink boot or mechanical enclosure is secured over the splice.

The following Examples further illustrate various aspects of the invention. Unless otherwise indicated, the ingredients are combined using methods known in the art or as described above.

EXAMPLE 1

A batch of cleaning solution was prepared in accordance with the preferred embodiment of the present invention by blending together about 70parts by volume n-propyl bromide and about 30 parts by volume ethyl acetate. The cleaning solution with the foregoing formulation (hereinafter referred to as the "Inventive Solution") was used in Examples 1, 2, and 3.

A batch of n-propyl bromide (NPB) was obtained from Petroferm, Inc. of Fernandina Beach Florida, and a batch of 1,1,1 Trichloroethane (TCA) was obtained, prior to the 1996 ban, from Dow Chemical Co. of Midland, Mich. Various properties of the Inventive Solution (INV) batch, the NPB batch and the TCA batch were tested and compared, with the results being set forth below in tabular summary form.

The cleaning, or stripping properties of the batches were tested using three pieces of white cloth and three pieces of high-voltage power cable stripped down to an inner semi-conductive layer composed of polyethylene having a black color. The pieces of cloth were soaked in the respective batches. The pieces of cloth were then wiped over the respective cables three times, with substantially the same pressure being applied to each piece of cloth during the wipes. The pieces of cloth were then visually inspected for the darkness of the matter deposited on the pieces of cloth, thereby indicating the amount of semi-conductive layer removed. Based on this observation, each batch was rated on a scale of "poor", "fair", "good", and "excellent".

The evaporation rates of the batches were measured using ASTM D 1901. The flash points of the batches were measured using ASTM D 93. The dielectric strengths of the batches were measured using ASTM D 877. The non-volatile residues were measured using ASTM D 2369.

The exposure value is the ratio of permissible exposure limit (PEL) to evaporation rate. Except for the Inventive Solution, PEL is determined by the Occupational Safety & Health Administration (OSHA). The PEL is a time weighted average (TWA) concentration (in parts per million) that worker exposure should not exceed in any 8-hour shift of a 40-hour work week. The PEL for the Inventive Solution is a projected value, based upon the PELs of its constituent components.

The kauri-butanol values are the milliliters of the respective batches needed to cause cloudiness in a solution of kauri gum in butyl alcohol.

The cost values are determined as the ratio of the cost of constituent components or blends thereof to the cost of petroleum distillate; petroleum distillate being the lowest cost solvent cleaning constituent available in the industry.

| Property | TCA | NPB | INV |
|---|---|---|---|
| Semi-Conductor Stripping | excellent | good | excellent |
| Evaporation Rate nBA = 1 | 6.0 | 8.0 | 6.0 |
| Flash Point | none | none | none |
| Exposure Value | 58.3 | 12.5 | 28.0 |
| Dielectric Strength | 40,000 | 42,000 | 40,000 |
| Kauri Butanol number | 124 | 125 | 145 |
| Non-volatile residue | <25 ppm | <25 ppm | <30 ppm |
| Cost Level | **** | 12.1 | 9.3 |

As indicated by the above results, the Inventive Solution demonstrates stripping properties equal to TCA and better than NPB. In addition, the Inventive Solution has an evaporation rate equal to TCA and lower than NPB, which is desirable when the Inventive Solution is used to clean high-voltage power cables. Also, the Inventive Solution has an exposure value greater than NPB, thereby indicating that the Inventive Solution can be used for a longer period of time without exceeding its PEL than NPB. Except for cost, the remaining properties of the Inventive Solution are comparable to both TCA and NPB. The Inventive Solution is substantially less expensive than NPB and TCA (which is unavailable).

The results of this Example 1 show that the cleaning solution of the present invention can be used in place of TCA in those applications where TCA was formerly used, with substantially similar results. This is surprising and unexpected.

EXAMPLE 2

Batches were formed of Products A, B, and C, which are similar to cold-cleaning solutions currently being used as replacements for TCA. Product A is a blend of about 93 volume percent hydrocarbon distillate and about 7 volume percent d-Limonene (terpene). Product B is about 100 volume percent Freon 113 trichloro-trifluoro ethane. Product C is a blend of about 50 volume percent hydrocarbon distillate and about 50 volume percent methyl n-amyl ketone. Various properties of the INV batch, the Product A batch, the Product B batch, and the Product C batch were tested and compared using the same methods as in Example 1. The results of these tests are set forth below in tabular summary form.

| Property | INV | A | B | C |
|---|---|---|---|---|
| Semi-Conductor Stripping | excellent | good | poor | fair |
| Evaporation Rate nBA = 1 | 6.0 | .1 | 13.3 | .2 |
| Flash Point | none | 140° F. | none | 102° F. |
| Exposure Value | 28 | 3000 | 75.2 | 1500 |
| Dielectric Strength | 40,000 | 23,000 | 40,000 | 30,000 |
| Kauri Butanol number | 145 | 30 | 31 | 34 |
| Non-volatile residue | <30 ppm | <250 ppm | <25 ppm | <50 ppm |
| Cost Level | 9.3 | 1.5 | 31.4 | 2.2 |

As indicated by the above results, the Inventive Solution demonstrates stripping properties better than Products A, B, and C. In addition, Products A and C have flash points, indicating that they are flammable, whereas the Inventive Solution is non-flammable. Product B has a much higher evaporation rate than the Inventive Solution, and is much more expensive than the Inventive Solution.

The results of this Example 2 show that, overall, the cleaning solution of the present invention has significantly better cleaning properties than Products A, B, and C, which are similar to cold-cleaning solutions currently being used as replacements for TCA. This is surprising and unexpected.

EXAMPLE 3

Batches of cleaning solutions, including the Inventive Solution (INV), TCA, NPB, and Products A and D were tested for their effect on the volume resistivity of pieces of high-voltage power cable stripped down to an inner semi-conductive layer composed of polyethylene. Product D is a blend of about 70 volume percent n-propyl bromide and about 30 volume percent hexane.

The tests were conducted using a modified version of Insulated Cable Engineers Association (ICEA) T-25-425. The tests are described below with regard to only one batch and one piece of cable, it being understood that the same procedure was followed for each batch and piece of cable therefor.

An outer jacket of a 9.5" piece of cable was removed, along with concentric neutrals to expose an outer semi-conductive layer. Four silver electrodes were applied to the cable: two potential electrodes at a separation of about 4" around the center and two current electrodes at a separation of about 6" around the center. The current electrodes were attached to a circuit including a 10.2 kΩ resistor and a 100 VAC power source. The voltage across the cable and across the resistor were measured with voltmeters. The current was calculated across the resistor. Using the calculated current, the resistance between the potential electrodes was calculated. The resistance was multiplied by the volume of the outer semi-conductive layer to obtain volume resistivity.

An initial measurement, $T_0$, was taken. A strip of cloth soaked in the batch was then wrapped around the cable between the electrodes and allowed to sit for a period of about 10 minutes. After about ten minutes, the strip of cloth was unwrapped and removed, and a measurement ($T_{10}$) was taken. The cable was allowed to sit and subsequent measurements were taken after 35 minutes ($T_{45}$), 50 minutes ($T_{60}$), 110 minutes ($T_{120}$), and 24 hours ($T_F$). The percent change from $T_0$ was calculated for each measurement and is set forth below in tabular summary form.

| Batch | $T_{10}$ | $T_{45}$ | $T_{60}$ | $T_{120}$ | $T_F$ |
|---|---|---|---|---|---|
| TCA | 23.4 | 54.6 | 55.7 | 35.7 | 4.8 |
| NPB | 49.6 | 135.5 | 138.6 | 53.1 | 9.3 |
| Hexane | 48.6 | 146 | 164 | 127 | 21.6 |
| d-Limonene | 51.9 | 222 | 347 | 1290 | 132 |
| Product D | 55.9 | 197 | 205 | 105 | 15.4 |
| Product A | 29.5 | 75.6 | 92.2 | 164 | 48.3 |
| INV | 38.6 | 67.9 | 67.9 | 28.9 | 3.6 |

The foregoing results show that the Inventive Solution has a lower $T_F$ than all of the other batches, including the NPB and Product D. Thus, the Inventive Solution increases the volume resistivity of the semi-conductor layer less than all of the other batches. With a $T_F$ of only 3.6, the Inventive Solution only slightly increases the volume resistivity of the cable. This is desirable because a substantial increase in volume resistivity at the splice will cause a hot spot to form at the splice when current flows through the cable, thereby leading to degradation of the primary insulation layer and ultimate failure of the cable at the splice.

The results this Example 3 show that a splice in a high-voltage power cable is less likely to fail if the cable is cleaned with the cleaning solution of the present invention, than if the cable is cleaned with TCA, NPB alone, or any of the other tested solvents. This is surprising and unexpected.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A method of cleaning a power cable in preparation for splicing, said cable comprising a conductor successively surrounded by a semi-conductive layer, an insulating layer, and an outer jacket, said method comprising the steps of:

selecting a cleaning solution comprising a brominated hydrocarbon selected from the group consisting of n-propyl bromide and isopropyl bromide;

selecting a piece of material for absorbing the cleaning solution;

removing a portion of the insulating layer and the outer jacket to expose a portion of the semi-conductive layer;

soaking the piece of material with the cleaning solution; and cleaning the power cable by wiping the semi-conductive layer with the piece of material soaked with the cleaning solution, wherein the cleaning solution comprising the brominated hydrocarbon selected from the group consisting of n-propyl bromide and isopropyl bromide removes at least a portion of the semi-conductive layer.

2. The method of claim 1, wherein the cleaning solution further comprises an ester having the formula $C_nH_{2n}O_2$, where n is a number from 2 to 8.

3. The method of claim 1, further comprising the step of removing a second portion of the semi-conductive layer using a stripping tool before wiping the semi-conductive layer with the piece of material soaked with the cleaning solution.

4. The method of claim 1, wherein the brominated hydrocarbon comprises about 40–98 volume percent of the cleaning solution.

5. The method of claim 2, wherein the ester is ethyl acetate.

6. The method of claim 2, wherein the ester is tert-butyl acetate.

7. The method of claim 4, wherein the brominated hydrocarbon is n-propyl bromide.

8. The method of claim 5, wherein the brominated hydrocarbon comprises about 55–85 volume percent of the cleaning solution, and the ethyl acetate comprises about 15–45 volume percent of the cleaning solution.

* * * * *